US012121790B2

(12) United States Patent
Cardoso

(10) Patent No.: US 12,121,790 B2
(45) Date of Patent: Oct. 22, 2024

(54) SWIMMING EXERCISING SYSTEM AND METHOD OF USE

(71) Applicant: Lidia S. B. Cardoso, Boca Raton, FL (US)

(72) Inventor: Lidia S. B. Cardoso, Boca Raton, FL (US)

( * ) Notice: Subject to any disclaimer, the term of this patent is extended or adjusted under 35 U.S.C. 154(b) by 164 days.

(21) Appl. No.: 17/867,758

(22) Filed: Jul. 19, 2022

(65) Prior Publication Data

US 2023/0302341 A1 Sep. 28, 2023

Related U.S. Application Data

(60) Provisional application No. 63/322,786, filed on Mar. 23, 2022.

(51) Int. Cl.
*A63B 69/12* (2006.01)
*A63B 69/00* (2006.01)

(52) U.S. Cl.
CPC ..... *A63B 69/12* (2013.01); *A63B 69/0059* (2013.01); *A63B 2208/03* (2013.01)

(58) Field of Classification Search
CPC ..... A63B 21/00185; A63B 21/0552; A63B 21/068; A63B 24/0062; A63B 2024/0071; A63B 2220/833; G01L 5/101
See application file for complete search history.

(56) References Cited

U.S. PATENT DOCUMENTS

| | | | | |
|---|---|---|---|---|
| 3,512,416 | A * | 5/1970 | George | A63B 69/12 482/55 |
| 5,556,353 | A * | 9/1996 | Beers | A63B 69/12 482/122 |
| 7,442,151 | B1 * | 10/2008 | Berdegue | A63B 69/12 434/254 |
| 10,004,936 | B1 * | 6/2018 | Ekstrom | A63B 21/0604 |
| 2006/0287166 | A1 * | 12/2006 | Alvarez | A63B 69/0057 482/55 |
| 2008/0085817 | A1 * | 4/2008 | Brentlinger | A63B 31/00 482/55 |
| 2021/0252362 | A1 * | 8/2021 | Allen | A63B 67/066 |
| 2024/0075369 | A1 * | 3/2024 | Lysenko | A63B 69/12 |

FOREIGN PATENT DOCUMENTS

| | | | | |
|---|---|---|---|---|
| DE | 202004000811 U1 * | 5/2004 | | A63B 69/12 |
| WO | WO8203790 A1 * | 11/1982 | | A63B 69/12 |

* cited by examiner

*Primary Examiner* — Sundhara M Ganesan
*Assistant Examiner* — Jacqueline N L Loberiza
(74) *Attorney, Agent, or Firm* — Brennan, Manna & Diamond, LLC

(57) ABSTRACT

The present invention relates to a swimming and aquatic exercise system and a method of use thereof. The exercise system includes a modified vest that has a ring rotatably affixed to a back portion of the vest. The vest has adjustable straps and a waist belt to secure the vest around a swimmer. A rope is removably attached to the ring using a cord hook wherein the opposite end of the rope is fastened to an anchor or any other fixed point around a pool. In use, the vest is worn by a swimmer to enable the swimmer to perform a full body aquatic workout while the fastened rope prevents the swimmer from advancing forward, and therefore enables the swimmer to swim and perform water exercises in place without getting in the way of other users of the pool.

20 Claims, 5 Drawing Sheets

SWIMMING EXERCISING SYSTEM AND METHOD OF USE

CROSS-REFERENCE TO RELATED APPLICATION

The present application claims priority to, and the benefit of, U.S. Provisional Application No. 63/322,786, which was filed on Mar. 23, 2022 and is incorporated herein by reference in its entirety.

FIELD OF THE INVENTION

The present invention relates generally to the field of swimming and aquatic exercises. More specifically, the present invention relates to an exercise device configured to enable a swimmer to perform aquatic exercises without advancing forward in a body of water such as a pool. The device enables users to swim in any sized pool and features a modified swimming vest capable of being anchored to an anchor or any fixed point using an elastic bungee cord enabling a wearer of the vest to perform full body aquatic workouts by staying in place and not advancing forward. The cord/rope is removably attached to the back portion of the vest using a D-ring and cord hook. Accordingly, the present disclosure makes specific reference thereto. Nonetheless, it is to be appreciated that aspects of the present invention are also equally applicable to other like applications, devices, and methods of manufacture.

BACKGROUND

By way of background, swimming is considered as a beneficial all-round exercising activity as swimming keeps heart rate up and takes impact stress off the body. Further, swimming builds endurance, muscle strength, and cardiovascular fitness and assists in toning muscles. In addition to swimming, individuals like performing aquatic exercises in pools. Aquatic exercises reduce pain and stiffness. Individuals who participate in aquatic exercises have reported improved bowel function. Further, aquatic exercises provide whole body conditioning and less injury concerns.

Individuals specifically prefer swimming and aquatic exercises because they also provide recreation, while other physical exercises such as running, cycling, and more often leads to joint pain, arthritis, shin splints, muscle sprains, and other injuries. Individuals working out on treadmills and other exercising equipment also complain of pain, tiredness, and stiffness.

However, a common problem faced by individuals doing swimming and aquatic exercises is the limited size of the pool. In home-owned pools and small pools, individuals are not able to efficiently perform exercises due to the small size of pools. A swimmer must do a lot of to and from motion between the two end points of the pool while swimming that not only reduces the efficiency but also causes fatigue.

For overcoming problems with their own pool, individuals use public pools. However, in public pools, a lot of individuals simultaneously perform exercises and perform swimming and therefore, wherein individuals come in the way of each other while performing said exercises and swimming. Many times, individuals do not get a vacant slot or lane in the pool to perform swimming exercise. Swimming by nature and design, enables individuals to advance forward or backward and therefore, individuals come in others' way while exercising. Individuals desire a system that can be used by swimmers for enabling them to do aquatic exercises without advancing forward in pool.

In order to efficiently perform aquatic exercises without any discomfort, waiting and more, individuals purchase expensive memberships of various pools and gyms, which is expensive and frustrating. Individuals desire a system to overcome the stated problems in performing aquatic exercises.

Therefore, there exists a long felt need in the art for an exercising device that enables swimmers to do aquatic exercises without advancing forward in the pool or body of water. There is also a long felt need in the art for an exercising system that enables users to perform complete workout and exercises while being anchored in place. Additionally, there is a long felt need in the art for an aquatic exercising system that can be used in pools of any size ranging from small home pools to Olympic-sized pools. Moreover, there is a long felt need in the art for an exercising device and system that eliminates the problems of swimmers coming into each other's way while performing aquatic workout. Further, there is a long felt need in the art for a pool exercising system that reduces the waiting time of individuals at the pool and is also cost-effective and easy to use. Finally, there is a long felt need in the art for an exercise system that tethers a swimmer in a stationary orientation, saves extensive money and time, and eliminates the need to purchase expensive gym and public pool memberships.

The subject matter disclosed and claimed herein, in one embodiment thereof, comprises an aquatic exercise system. The exercise system is configured to be used by swimmers for performing full body aquatic exercises in a body of water such as a water pool without advancing forward in the body of water. The exercise system further comprising a tethered vest, an elastic bungee rope, and an anchor; the vest device features a D-ring attachment and is configured to be worn by a swimmer, the D-ring attachment, or pivotal securement ring, is used for removably fastening the rope using an elastic bungee shock cord hook wherein the opposite end of the rope is fastened to the anchor. The anchor is positioned near the body of water in which the swimmer wearing the vest performs exercises. The rope provides resistance to the advance movement of the swimmer in the pool enabling the swimmer to perform full body workouts and exercises in a stationary orientation or position in the body of water.

In this manner, the aquatic exercise system of the present invention accomplishes all of the forgoing objectives and provides users with a modified swimming vest capable of being anchored to the pool frame or an anchor and enabling wearers to swim and perform exercises in place. The system enables users to work out via swimming in any size pool by staying anchored in place. The system saves extensive money and time, eliminating the need to purchase expensive gym and public pool memberships.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a swimming exercise system. The swimming exercise system is used for performing exercises in a body of water without advancing forward in the body of water. The swimming exercise system further comprising a tethered vest device, an elastic bungee rope, and an anchor; the vest device is configured to be worn by a swimmer and is tethered using the bungee rope. The vest features a D-ring attachment (i.e. pivotal securement ring) for removably fastening the rope using an elastic bungee shock cord hook wherein the opposite end of the rope is fastened to the anchor. The anchor is positioned near the body of water in which the swimmer wearing the vest performs exercises such that the swimmer advances forward in the body of water until the rope becomes taut and thereafter, the rope provides resistance to the advance movement of the swimmer in the pool enabling the swimmer to perform full body workouts and exercises in a stationary orientation or position in the body of water.

In yet another embodiment, an aquatic exercise system is disclosed. The aquatic exercise system includes a floating vest with at least one D-ring attachment affixed to a back portion at the vest wherein the back portion covers the back of a swimmer when the vest is donned by a swimmer, the vest has adjustable straps for adjusting a size of the vest; an elastic bungee rope attached to the D-ring attachment using a fastener wherein the opposite end of the bungee rope is attached to an anchor positioned near a pool in which the swimmer donning the vest performs swimming exercises; the bungee rope provides resistance to the advance movement of the swimmer in the pool and enables the swimmer to perform exercise without advancing forward and thus the swimmer can perform said exercises in small pools, public pools, and more.

In yet another embodiment, the rope is attached to the D-ring attachment using an elastic bungee shock cord hook.

In yet another embodiment, the opposite end of the rope can be fastened to one of a tree, a pool frame, a pool wall, or pool stairs, for example.

In yet another embodiment, the rope is removably attached to the D-ring attachment and the rope tethers the swimmer to a fixed point such as the anchor.

In yet another embodiment, the swimmer wearing the tethered vest does not advance and is able to perform a full body workout while remaining stationary in water.

In yet another embodiment, the vest device has padded shoulder pads that provide floatation and comfort to the swimmer.

In yet another embodiment, a tethered vest capable of being anchored to a fixed point is disclosed. The tethered vest is configured to be worn by a user for performing aquatic exercises in a body of water without advancing forward, the tethered vest has a pair of front straps attached to a waist belt, a pair of back straps sewn together in an X-shape (i.e. crisscross) with a common middle point, the waist belt is adjustable and is wrapped around the waist of the user, a D-ring attachment attached to said middle point wherein a rope is fastened to the said D-ring attachment and the opposite end of the rope is anchored to the fixed point for tethering the user while the user performs aquatic exercises.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
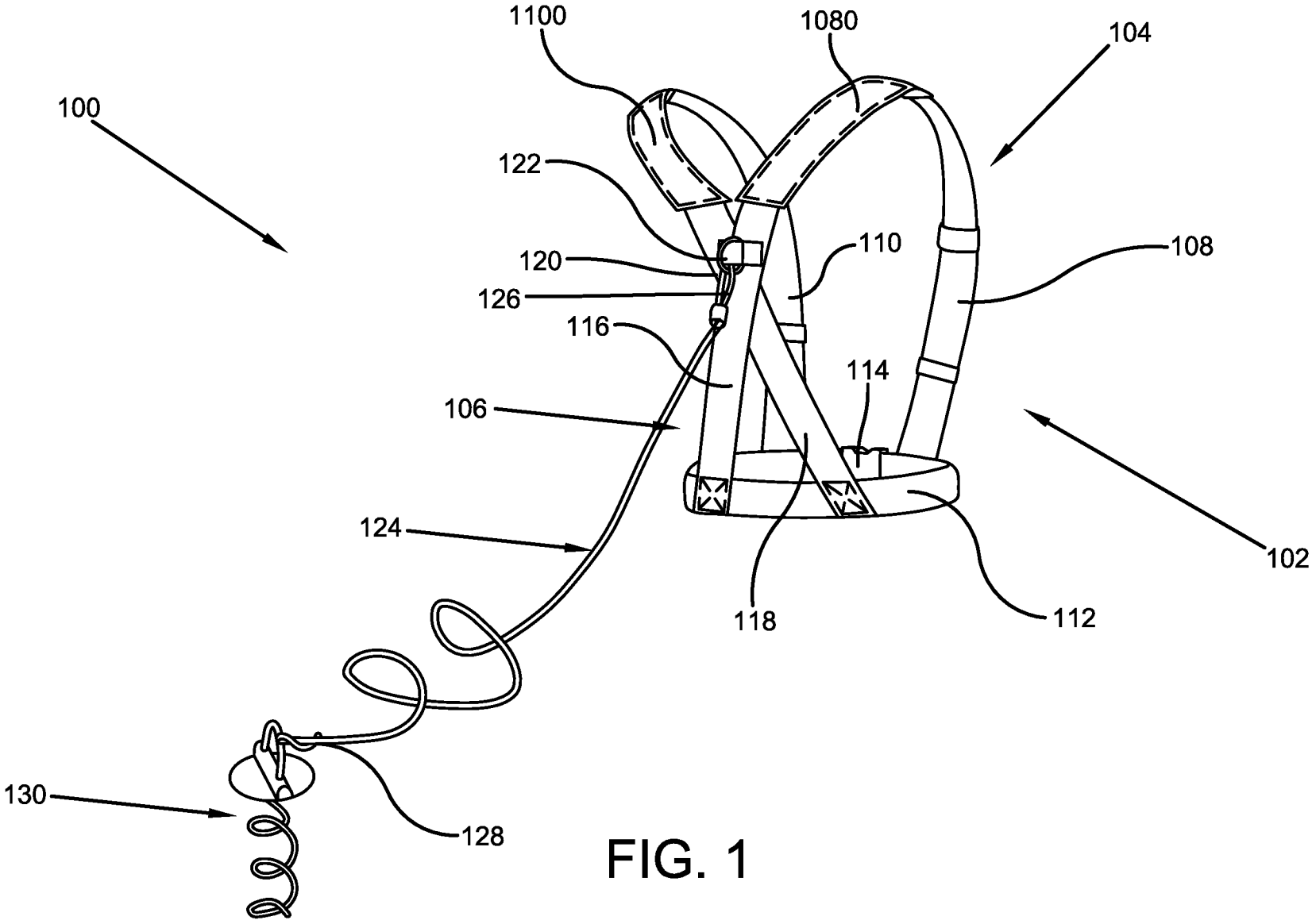
FIG. 1 illustrates a perspective view of one potential embodiment of the swimming exercise system of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for an exercising device that enables swimmers to do aquatic exercises without advancing forward in the pool or body of water. There is also a long felt need in the art for an exercising system that enables users to perform complete workout and exercises while being anchored in place. Additionally, there is a long felt need in the art for an aquatic exercising system that can be used in pools of any size ranging from small home pools to Olympic-sized pools. Moreover, there is a long felt need in the art for an exercising device and system that eliminates the problems of swimmers coming into each other's way while performing aquatic workout. Further, there is a long felt need in the art for a pool exercising system that reduces the waiting time of individuals at the pool and is also cost-effective and easy to use. Finally, there is a long felt need in the art for an exercise system that tethers a swimmer in a stationary orientation, saves extensive money and time, and eliminates the need to purchase expensive gym and public pool memberships.

The present invention, in one exemplary embodiment, is a tethered vest capable of being anchored to a fixed point. The tethered vest is configured to be worn by a user for performing aquatic exercises in a body of water without advancing forward, the tethered vest has a pair of front straps attached to a waist belt, a pair of back straps sewn together in an X-shape (i.e. crisscross) at a common middle point, the waist belt is adjustable and is wrapped around the waist of the user, a D-ring attachment attached to said middle point wherein a rope is fastened to the said D-ring attachment and the opposite end of the rope is anchored to the fixed point for tethering the user while the user performs aquatic exercises.

Referring initially to the drawings, FIG. 1 illustrates a perspective view of one potential embodiment of the swimming exercise system of the present invention in accordance with the disclosed architecture. The swimming exercise system 100 of the present invention is designed to enable users to work out via swimming in any size pool by enabling users to swim in place without advancing forward in the pool. More specifically, the exercise system 100 includes a tethering vest 102 configured to be worn by a user before going into the pool for performing exercises. The tethering vest 102 has a front portion 104 and a back portion 106. The front portion 104 includes a pair of adjustable straps 108, 110 attached to a waist belt 112. The waist belt 112 is configured to extend from the back portion 106 to the front portion 104. Each of the straps 108, 110 has a separate buckle (shown in FIG. 2) that enables the straps 108, 110 to adjust in length for accommodating different users. The waist belt 112 has a safety latch 114 in the form of a dual adjustable quick side release buckle for securing the vest 102 to the body of a swimmer (wearer) and for adjusting a length of the belt 112. When the vest 102 is donned by a swimmer, the safety latch 114 is positioned on the front and specifically on, or proximal to, the belly of the swimmer.

The straps 108, 110 are attached to shoulder pads 1080, 1100, respectively, wherein the shoulder pads 1080, 1100 are configured to go over the shoulders of a wearer. A pair of back straps 116, 118 are attached to the shoulder pads 1080, 1100 and are extended to cross each other in an X-shape (i.e. crisscross) to form the back portion 106. The X-shaped back straps 116, 118 are sewn together at the middle point 120 to provide support to the back portion of a wearer. The waist belt 112 is configured to adjustably extend around the waist of a wearer and the X-shaped straps 116,118 are sewn to the waist belt 112. At the X-point 120, a D-ring attachment or pivotal securement ring attachment 122 is affixed for enabling a rope or tether 124 of the exercise system 100 to removably attach to the D-ring attachment 122. The D-ring attachment, or securement ring, is pivotal relative to the back portion 106 to accommodate the 'roll' motion of a swimmer while swimming.

The rope or tether 124 may be designed as an elastic bungee style leash and includes a cord hook 126 positioned at opposite ends or a cord hook 126 at one end and a clasp 128 at the opposite end. The cord hook 126 is configured to be removably attached to the D-ring attachment 122 for enabling a wearer wearing the vest 102 to couple with the rope or tether 124. The clasp 128 is configured to attach to an ground anchor 130 positioned at an appropriate position such as near a pool. The ground anchor 130 can be a ground anchor and assists in tethering the vest 102 thereby preventing a swimmer wearing the vest 102 from advancing forward while the swimmer performs water exercises in the pool. It should be appreciated that the rope or tether 124 can be fastened to a pool's ladder or any other fixed item, instead of the ground anchor 130, depending on the position and surroundings of the pool. Further, the rope or tether 124, while preventing the swimmer wearing the tethered vest 102 from advancing forward, does not provide a jerk to the swimmer.

When the vest 102 is donned by a swimmer, the front portion 104, the back portion 106, and the waist belt 112 are securely clasped to the body of the swimmer such that the vest 102 does not move or slide by a pulling force of the rope or tether 124 when exercises are performed by the swimmer. The vest 102 can be made from polyester, EPE foam, nylon, PVC material, or any other similar material. Further, the vest 102 comes in different colors, designs, and sizes to meet requirements of different users. The vest 102 is also designed to provide maximum buoyancy for maximum comfort and mobility and is lightweight and easy to wear and remove. For providing additional comfort to a swimmer, the shoulder pads 1080, 1100 are padded with a soft and buoyant material such as Neoprene, that enables the swimmer to swim freely without any discomfort while the rope or tether 124 prevents the swimmer from advancing forward.

In various embodiments, the vest device 102 can be designed as a Coast Guard Approved personal floatation device (PFD). The vest device 102 preferably used as a safety flotation device enabling the system 100 to be used as a swimming training device. It should be noted that hands and legs of a swimmer remain free when the aquatic exercise system 100 is used, thereby enabling the swimmer to perform both easy and difficult exercises without any discomfort. Moreover, the vest 102 provides for a combination of upper body, leg, and abdominal movements in unison without advancing forward in the body of water/pool. The vest 102 can be of a color which provides a contrast with the water, e.g., blaze orange, can be used to increase the visibility of the vest 102.

The rope or tether 124 may be made of any suitable conventional flexible cord-like material resistant to exposure to the water and sunlight, preferably lightweight but strong enough to resist breakage under the forces associated with its use. The rope or tether 124 may be of any selected length appropriate for the size of body of water, and a length of about 20-40 feet has been found generally acceptable.

The ground anchor 130 can have a height from about 5 inches to about 20 inches and the anchor or the fixed point to which the rope is fastened can be at least 5 inches or higher than the water level (i.e. surface) of the pool or body of water so that the rope or tether 124 does not get tangled in the legs of the swimmer wearing the tethered vest 102. It should be noted that the ground anchor 130 can have any design and configuration depending on the location and surroundings of a pool in which the system 100 is to be used.

Figure 2:
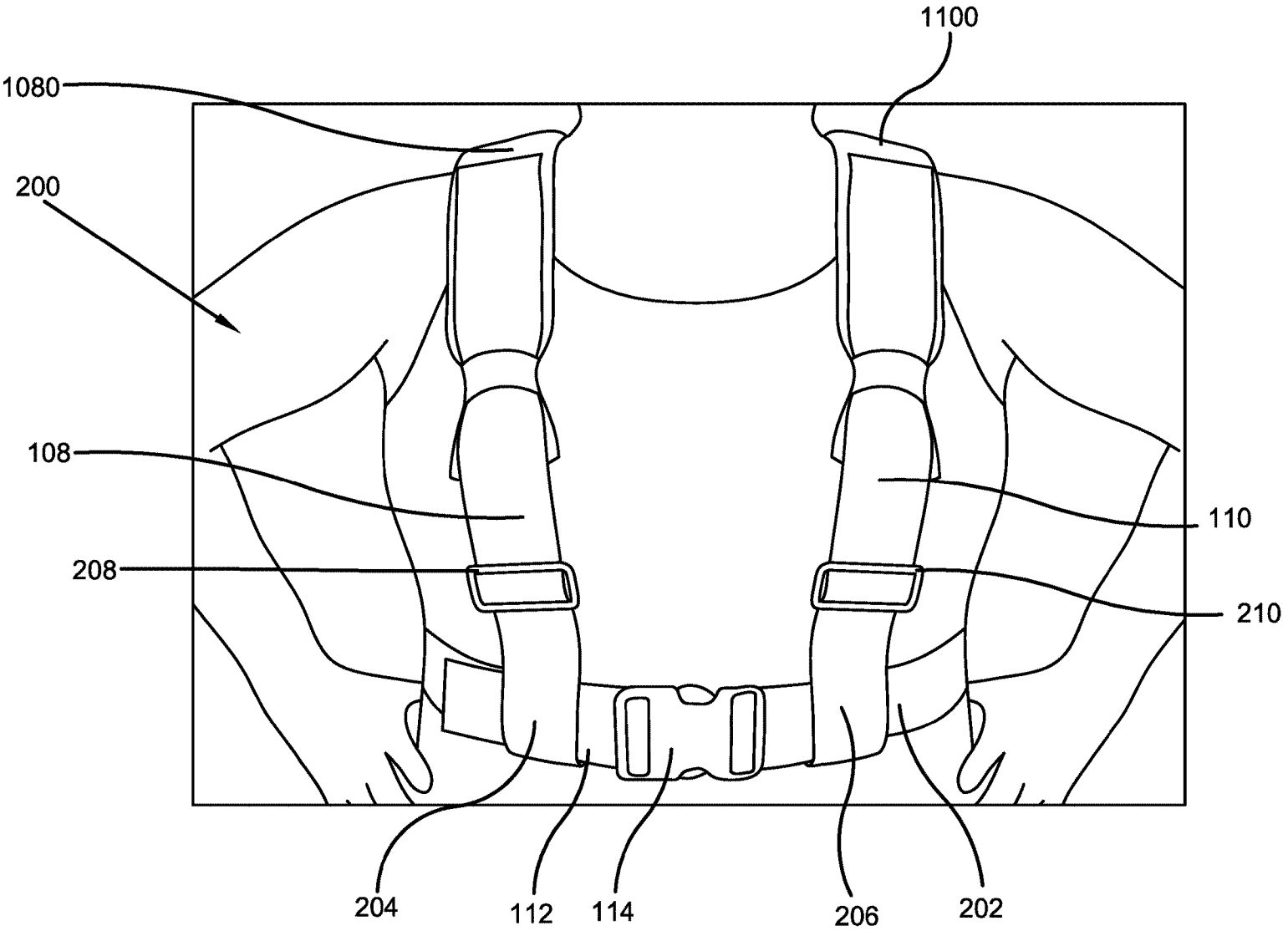
FIG. 2 illustrates a front perspective view of a swimmer wearing the tethered vest of the pool exercising system of the present invention in accordance with the disclosed architecture.

FIG. 2 illustrates a front perspective view of a swimmer wearing the tethered vest 102 of the pool exercising system 100 of the present invention in accordance with the disclosed architecture. As illustrated, the waist belt 112 is wrapped around the waist of the swimmer 200 and the safety latch 114 is positioned in front of the swimmer 200. The safety latch 114 is easily accessible for securing and removing the vest 102. Further, the waist belt 112 can be adjusted by pulling or loosening the end strap 202 portion of the waist belt 112.

The front straps 108, 110 are attached to the waist belt 112 through loops 204, 206, respectively, that enable the straps 108, 110 to remain substantially vertical while the waist belt 112 is adjusted. The plastic tri glide sliders 208, 210 on the straps 108, 110 enable the length of corresponding strap to adjust enabling swimmers of different sizes to wear the vest 102. The shoulder pads 108, 1100 can be sewn or attached through a water-resistant adhesive to the straps 108, 110 and are configured to protect and provide support to the shoulders of the swimmer 200. It should be noted that the vest 102 can be designed as a lifesaving vest in some embodiments of the present invention.

Figure 3:
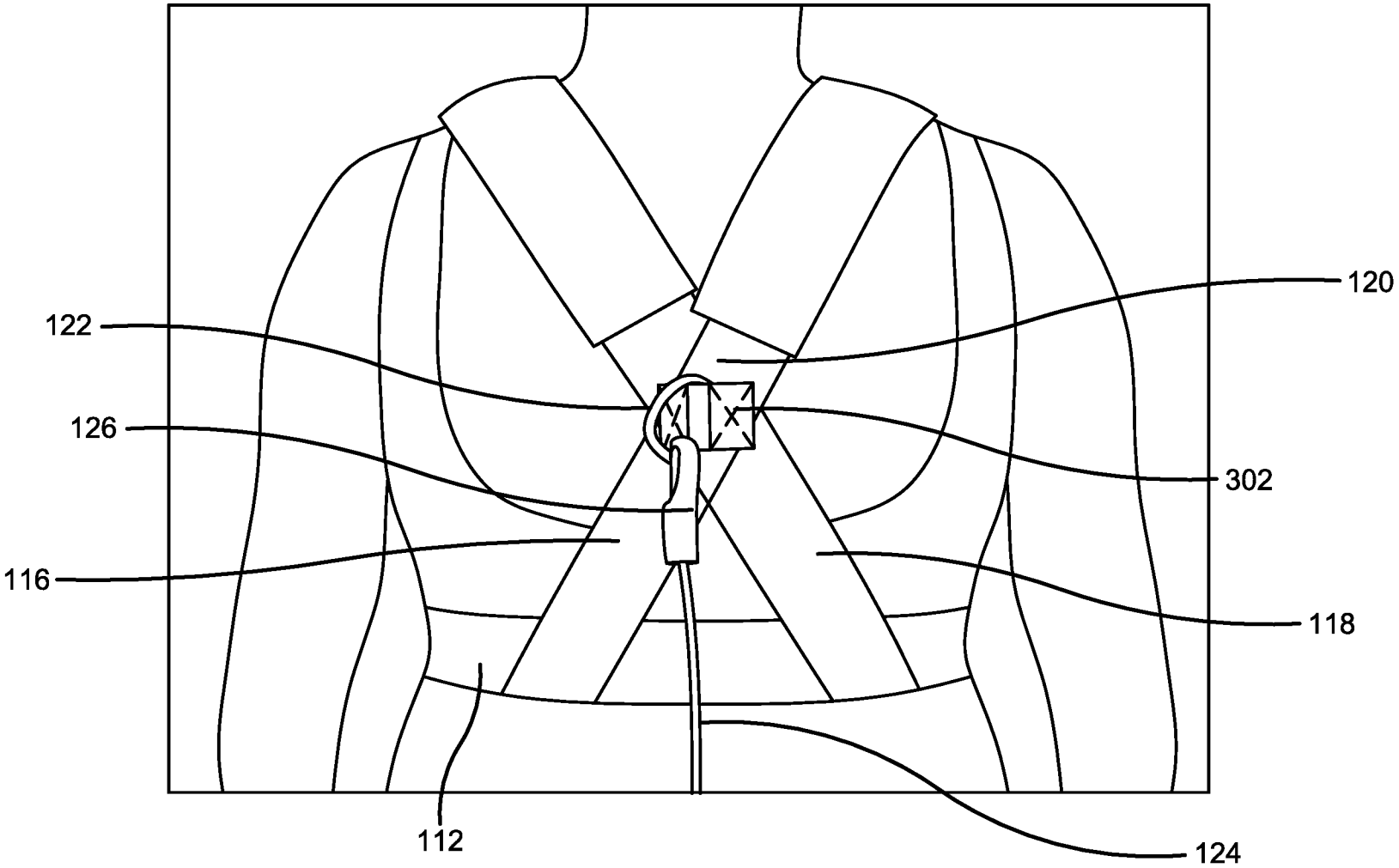
FIG. 3 illustrates a rear perspective view of a swimmer wearing the tethered vest of the pool exercising system of the present invention in accordance with the disclosed architecture.

FIG. 3 illustrates a rear perspective view of a swimmer wearing the tethered vest 102 of the pool exercising system 100 of the present invention in accordance with the disclosed architecture. The back straps 116, 118 are stitched together at the middle X-point 120 for supporting the back portion of the swimmer 200. More specifically, the D-ring attachment 122 is looped in the central loop patch 302 that enables the cord hook 126 of the rope or tether 124 to engage with the D-ring 122. The securement ring 122 can pivot or rotate relative to loop patch 302 and relative to back portion 106 in order to move with the 'roll' movements of the swimmer while swimming.

The back straps 116, 118 are sewn to the waist belt 112 for securing the vest 102 around the torso of the swimmer 200. The back straps 116, 118 can also include plastic tri glide sliders for adjusting the length of the back straps 116, 118. The back straps 116, 118 are sewn and attached to the front straps of the vest 102 enabling adjusting of size of the vest 102 to meet requirements of different users.

Figure 4:
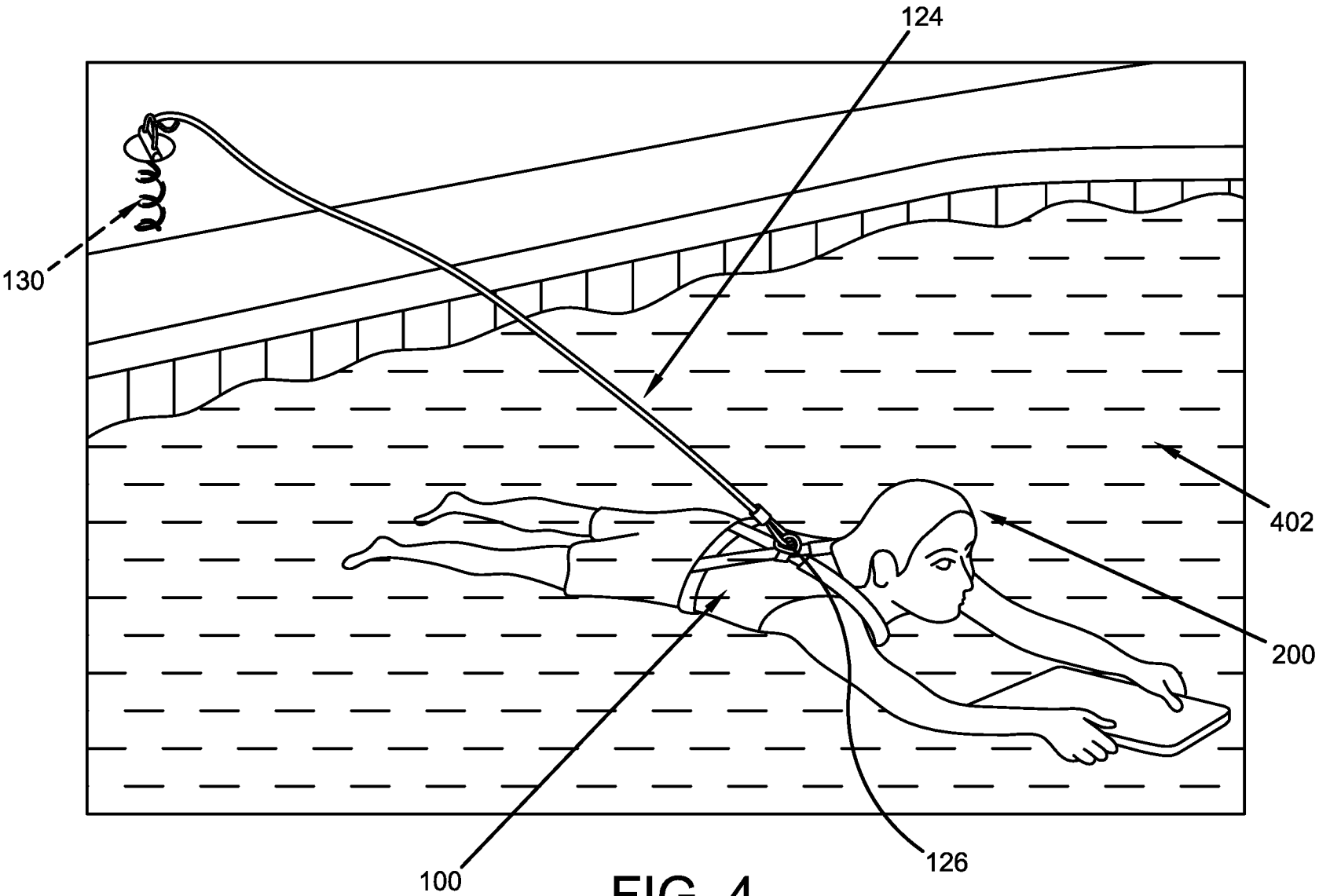
FIG. 4 illustrates a perspective view of the pool exercising system being used by a swimmer for performing exercise in a pool in accordance with the disclosed architecture.

FIG. 4 illustrates a perspective view of the pool exercising system 100 being used by a swimmer for performing exercise in a pool in accordance with the disclosed architecture. For performing exercises in a pool 402 without advancing forward in water, the swimmer 200 wears the tethered vest 102 such that front portion covers the front of the swimmer 200 as illustrated in FIG. 2 and the back portion covers the back of the swimmer 200 as illustrated in FIG. 3. The rope or tether 124 is attached to the vest 102 using the bungee shock cord hook 126 and the other end of the rope or tether 124 is anchored to the ground anchor 130. The ground anchor 130 can be temporarily drilled into the ground or any other surface, or alternatively, the rope or tether 124 can be anchored to a pool frame, a stair, an adjacent tree, or more, using a fastener.

The vest 102 enables the swimmer 200 to swim and perform exercises easily while the anchored rope or tether 124 prohibits the swimmer 200 from advancing forward in the pool and therefore, prevents the swimmer 200 from getting in the way of other swimmers and also prevents the other individuals from getting in the way of the exercising swimmer 200.

The length of the rope or tether 124 can be configured as per the pool size and preferences of the swimmer 200. In use, the rope or tether 124 enables the swimmer 200 to move ahead until the rope becomes taut, and after that the swimmer 200 becomes stationary and resistance provided by the rope or tether 124 prevents the swimmer 200 from advancing forward in the pool. Further, the system 100 is useful for swim training and preventing children from entering deep areas of a pool. The exercise system 100 can be used by individuals of all ages and genders and can be used in pools of all sizes including home-owned pools, Olympic-sized pools, and more.

Figure 5:
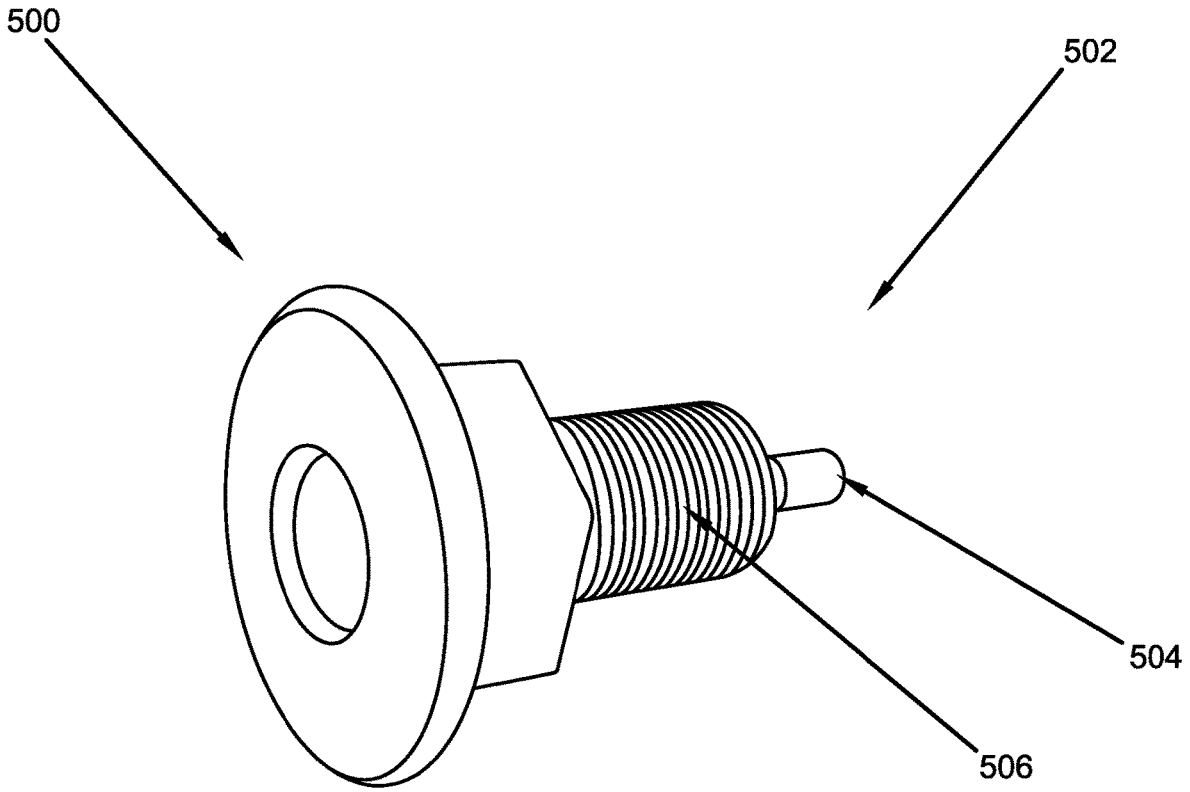
FIG. 5 illustrates a perspective view of another embodiment of the anchor used for fastening the rope in accordance with the disclosed architecture.

FIG. 5 illustrates a perspective view of another embodiment of the anchor used for fastening the rope in accordance with the disclosed architecture. In the present embodiment, the anchor 500 is configured for wood deck installation wherein the wood deck 502 is positioned around a pool. The bib fitting 504 is used for installing the anchor 500 into wood and the threaded portion 506 is used for anchoring the rope threaded to the vest device 102 as described in other embodiments of the present invention.

The aquatic exercising system 100 in accordance with the present disclosure can be used in water aerobic exercise programs in pools of all sizes, as well as for recreational use in large natural bodies of water, such as oceans or lakes.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "aquatic exercising system", "exercising system", "pool exercising system", and "swimming exercising system" are interchangeable and refer to the aquatic exercising system 100 of the present invention.

Notwithstanding the forgoing, the aquatic exercising system 100 of the present invention can be of any suitable size and configuration as is known in the art without affecting the overall concept of the invention, provided that it accomplishes the above stated objectives. One of ordinary skill in the art will appreciate that the aquatic exercising system 100 as shown in the FIGS. are for illustrative purposes only, and that many other sizes and shapes of the aquatic exercising system 100 are well within the scope of the present disclosure. Although the dimensions of the aquatic exercising system 100 important design parameters for user convenience, the aquatic exercising system 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A swimming exercise system comprising:

a tethering vest to be worn by a swimmer having a front portion and a back portion;

wherein said front portion comprises a pair of front adjustable straps attached to a waist belt of said vest;

wherein said waist belt extends from said back portion to said front portion;

wherein each of said front adjustable straps comprises a buckle for adjusting a length of said front adjustable straps;

wherein said waist belt comprises an adjustable release buckle safety latch for securing said vest to a body of the swimmer and for adjusting a length of said waist belt;

wherein said adjustable release buckle safety latch is positioned proximal to a belly area of the swimmer;

a pair of shoulder pads attached to said pair of front adjustable straps, wherein said pair of shoulder straps positioned over the shoulders of the body of the swimmer;

a pair of back straps attached to said pair of shoulder pads at a first end and to said waist strap at a second end, wherein said pair of back straps extend in an X-shape crossing area to form said back portion;

a pivotal securement ring attached to said X-shape crossing area of said back portion;

a tether removably attached to said pivotal securement ring at one end and removably attached to an anchor at an opposing end for enabling a swimmer to swim in place in a body of water;

wherein said pair of back straps are connected at said X-shape crossing area of said back portion; and wherein said pivotal securement ring is looped to a central loop patch that enables a cord hook of the tether to engage said pivotal securement ring, and wherein said pivotal securement ring can rotate relative to said central loop patch and said back portion of said waist belt in order to move with roll movements of the swimmer while swimming.

2. The swimming exercise system of claim 1, wherein said tether is an elastic bungee leash.

3. The swimming exercise system of claim 2, wherein said tether includes the cord hook at said one end for attachment to said pivotal securement ring and a clasp at said opposing end for attachment to said anchor.

4. The swimming exercise system of claim 3, wherein said anchor is a ground anchor.

5. The swimming exercise system of claim 4, wherein said tethering vest is a personal flotation device.

6. The swimming exercise system of claim 5, wherein said shoulder pads are buoyant.

7. The swimming exercise system of claim 6, wherein said tether comprises a length from about 20 feet to about 40 feet.

8. The swimming exercise system of claim 7, wherein said ground anchor comprises a height from about 5 inches to about 20 inches.

9. The swimming exercise system of claim 8, wherein said clasp is attached to said ground anchor at least 5 inches above a surface of the body of water.

10. A swimming exercise system comprising:

a tethering vest to be worn by a swimmer having a front portion and a back portion;

wherein said front portion comprises a pair of front adjustable straps attached to a waist belt of said vest;

wherein said waist belt extends from said back portion to said front portion;

wherein each of said front adjustable straps comprises a buckle for adjusting a length of said front adjustable straps;

wherein said waist belt comprises an adjustable release buckle safety latch for securing said vest to a body of the swimmer and for adjusting a length of said waist belt;

wherein said adjustable release buckle safety latch is positioned proximal to a belly area of the swimmer;

a pair of shoulder pads attached to said pair of front adjustable straps, wherein said pair of shoulder straps positioned over the shoulders of the body of the swimmer;

a pair of back straps attached to said pair of shoulder pads at a first end and to said waist strap at a second end, wherein said pair of back straps extend in an X-shape crossing area to form said back portion;

a pivotal securement ring attached to said X-shape crossing area of said back portion;

a tether removably attached to said pivotal securement ring at one end and removably attached to an anchor at an opposing end for enabling a swimmer to swim in place in a body of water;

wherein said pair of back straps are connected at said X-shape crossing area of said back portion;

wherein said tether includes a cord hook at said one end for attachment to said pivotal securement ring and a clasp at said opposing end for attachment to said anchor;

wherein said anchor is a ground anchor;

wherein said adjustable release buckle safety latch is a dual quick side release buckle; and wherein said pivotal securement ring is looped to a central loop patch that enables the cord hook of the tether to engage said pivotal securement ring, and wherein said pivotal securement ring can rotate relative to said central loop patch and said back portion of said waist belt in order to move with roll movements of the swimmer while swimming.

11. The swimming exercise system of claim 10, wherein said tether is an elastic bungee leash.

12. The swimming exercise system of claim 11, wherein said tethering vest is a personal flotation device.

13. The swimming exercise system of claim 12, wherein said shoulder pads are buoyant.

14. The swimming exercise system of claim 13, wherein said tether comprises a length from about 20 feet to about 40 feet.

15. The swimming exercise system of claim 14, wherein said ground anchor comprises a height from about 5 inches to about 20 inches.

16. The swimming exercise system of claim 15, wherein said clasp is attached to said ground anchor at least 5 inches above a surface of the body of water.

17. A swimming exercise system comprising:

a tethering vest to be worn by a swimmer having a front portion and a back portion;

wherein said front portion comprises a pair of front adjustable straps attached to a waist belt of said vest;

wherein said waist belt extends from said back portion to said front portion;

wherein each of said front adjustable straps comprises a buckle for adjusting a length of said front adjustable straps;

wherein said waist belt comprises an adjustable release buckle safety latch for securing said vest to a body of the swimmer and for adjusting a length of said waist belt;

wherein said adjustable release buckle safety latch is positioned proximal to a belly area of the swimmer;

a pair of shoulder pads attached to said pair of front adjustable straps, wherein said pair of shoulder straps positioned over the shoulders of the body of the swimmer;

a pair of back straps attached to said pair of shoulder pads at a first end and to said waist strap at a second end, wherein said pair of back straps extend in an X-shape crossing area to form said back portion;

a pivotal securement ring attached to said X-shape crossing area of said back portion;

a tether removably attached to said pivotal securement ring at one end and removably attached to an anchor at an opposing end for enabling a swimmer to swim in place in a body of water;

wherein said pair of back straps are connected at said X-shape crossing area of said back portion;

wherein said tether includes a cord hook at said one end for attachment to said pivotal securement ring and a clasp at said opposing end for attachment to said anchor;

further wherein said anchor is a deck anchor having a bib fitting for installing said anchor to a deck;

wherein said adjustable release buckle safety latch is a dual quick side release buckle;

wherein each back strap comprises a tri-glide slider for adjusting a length of respective back strap; and wherein said pivotal securement ring is looped to a central loop patch that enables the cord hook of the tether to engage said pivotal securement ring, and wherein said pivotal securement ring can rotate relative to said central loop patch and said back portion of said waist belt in order to move with roll movements of the swimmer while swimming.

18. The swimming exercise system of claim 17, wherein said tether is an elastic bungee leash.

19. The swimming exercise system of claim 18, wherein said tethering vest is a personal flotation device.

20. The swimming exercise system of claim 19, wherein said tether comprises a length from about 20 feet to about 40 feet.

* * * * *